US006623383B2

(12) United States Patent
Matsuoka et al.

(10) Patent No.: US 6,623,383 B2
(45) Date of Patent: Sep. 23, 2003

(54) RACQUET WITH SLIDABLE WEIGHT

(75) Inventors: Toyotake Matsuoka, Saitama (JP); Satoshi Shirai, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/076,442

(22) Filed: Feb. 19, 2002

(65) Prior Publication Data

US 2002/0160866 A1 Oct. 31, 2002

(30) Foreign Application Priority Data

Feb. 20, 2001 (JP) ..... 2001-042969
Dec. 10, 2001 (JP) ..... 2001-375572

(51) Int. Cl.[7] ..... A63B 49/02

(52) U.S. Cl. ..... 473/519; 473/537; 473/520; 473/521

(58) Field of Search ..... 473/519, 520, 473/521, 524, 537

(56) References Cited

U.S. PATENT DOCUMENTS 3,907,292 A * 9/1975 Moreland ..... 473/537
4,984,792 A * 1/1991 Pacanski ..... 473/519
5,039,097 A * 8/1991 Bartlett ..... 473/519
5,054,780 A * 10/1991 Chen ..... 473/519
5,100,136 A * 3/1992 Chen ..... 473/519
5,188,360 A * 2/1993 Chen ..... 473/519
5,779,571 A * 7/1998 Roggenkamp ..... 473/519
2002/0160866 A1 * 10/2002 Matsuoka et al. ..... 473/519

FOREIGN PATENT DOCUMENTS

| | | | | |
|---|---|---|---|---|
| JP | 63-318966 | | 6/1987 | |
| JP | 64-40071 | | 2/1989 | |
| JP | 4-870 | | 1/1992 | |
| JP | 4-27953 | | 3/1992 | |
| WO | WO 88/01890 | * | 3/1988 | ..... A63B/49/04 |

* cited by examiner

*Primary Examiner*—Raleigh W. Chiu
(74) *Attorney, Agent, or Firm*—Sughrue Mion, PLLC

(57) ABSTRACT

A racket comprising a frame body having a face portion, a shaft portion, and a grip portion, and a groove in the length of 10% to 20% against the entire circumference of the frame comprising the face portion provided at two portions covering maximum width points of the frame comprising the face portion and a closed tube enclosing a slidable weight weighing 2 g to 10 g is embedded in the groove.

20 Claims, 8 Drawing Sheets

RACQUET WITH SLIDABLE WEIGHT

BACKGROUND OF THE INVENTION

The present invention relates to a racket used in sport events such as tennis, badminton, and squash (or formally a squash racquets), and more particularly to a racket capable of striking strong balls by an increased moment of inertia effectuated by moving the center of gravity in the direction of racket head (or racket tip) at the time of the swing.

DESCRIPTION OF THE RELATED ART

There have been various inventions disclosed conventionally for rackets which are capable of shifting their center of gravities in the direction of the racket heads. Such inventions include rackets disclosed in JP-A (Japanese Patent Application Laid-Open) No. 63-318966, 64-40071, and JP-U (Japanese Utility Model Application Laid-Open) No. 04-870, and 04-27953.

For instance, JP-A 63-318966 discloses a racket which disposes narrow tubes or narrow holes along the stringing frame and the neck portion, within which a moving body is inserted in a state to move around freely. At the time of swinging the racket strongly, the moving body moves in the direction of the racket head by centrifugal force caused by the swing, and moves the point (or location) of the center of gravity of the racket towards the racket head.

According to this invention, a racket capable of shifting its center of gravity to strike back strong balls feels relatively light at the beginning of the swing, changes to top heavy, utilizing a principle of pendulum.

JP-A 64-40071 teaches a racket comprising a frame defining an outer portion of the hitting surface, a grip connected to the frame, stringing provided within an outer hull defined by the frame to configure a hitting surface, wherein a balancer capable of moving freely between a position closer to the grip and a position opposite which is closer to the racket head, is provided at the frame, and an urging means to constantly urge the balancer to the position closer to the grip.

JP-U 4-27953 demonstrates a tennis racket which forms a frame and a grip as one continuous pipe wherein a fluid body such as water is filled within the pipe leaving out some spaces.

According to this tennis racket, when a player swings the racket horizontally, the centrifugal force carries the water within the pipe in the direction of the racket tip, making the racket in a state of top heavy. On the other hand, when the racket is stood up vertically as in the case of hitting volleys, the water remains around the grip, leaving the racket tip relatively lighter, thus lightens the swing itself.

However, by using the racket disclosed in JP-A 63-318966, there is a risk of destroying the cylinder body by accidental contact with a ball, when cylinder body enclosing a balancer is disposed along the inner circumference of the face portion of the racket frame. Also, because the cylinder body restrains the motion of the stringing (i.e., interferes with the stringing) provided within the inner circumference of the face portion, there is a risk of losing rebounding force of the ball being hit by the racket. On the other hand, when the cylinder body is disposed on the outer circumference of the face portion of the frame, there is a risk of damaging the cylinder body by accidental impact with the ground in an attempt to strike back low balls, or disturbs the swing, which leads to inferior maneuverability of the racket.

The racket disclosed in the aforementioned JP-A 64-40071 may have a problem of damaging the racket during the play, which attributes to disposition of the balancer in the frame, as with the racket of JP-A 63-318966.

A racket disclosed in JP-U 4-27953 may exhibit uncomfortable feeling of use during the swing when tapping noise of the water injected in the pipe caused by leaving out some air spaces within the pipe moves inside the frame, leading to plurality of water surfaces existing in the pipe. The racket may be slow in shifting the center of gravity since the air within the pipe may be divided into some air lumps which moves in opposite direction to the water, and since the difference of the specific gravity of water and that of the air is as small as 1, when the centrifugal force is exerted to the water and the air, the lumps of air moves slowly, and leads to decreased moving speed of the center of gravity. Further, when the racket is rapidly shaken, air lumps are decoupled in many minute air bubbles, and since the moving resistance of the bubble in water is extremely large, causes the motion of the bubbles to slow down, which generates slow movement in the center of gravity when the racket is shaken.

SUMMARY OF THE INVENTION

Under such circumstances, an object of the present invention is to overcome aforementioned problems, and to achieve a goal described hereinafter. The object of the present invention is to provide a racket, specifically a tennis racket devised to striking back strong balls by an increased moment of inertia, which demonstrates a smooth shift in the center of gravity of the racket during the swing.

A racket comprising a frame body having a face portion, a shaft portion, and a grip portion, wherein grooves, which are the length of 10% to 20% of the entire circumference of the face portion of the frame body, are provided at two maximum width points of the face portion. A closed tube enclosing a slidable weight weighing 2 g to 10 g is disposed in the groove.

According to the present invention, the racket is used for use in badminton, squash, or preferably tennis and is capable of striking strong balls, and demonstrating outstanding increase in the moment of inertia is provided which comprises a groove adjusted in the shape and length of a tube which encloses a lead of predetermined length, provided in two portions covering the points of maximum width of a frame comprising a face portion. By embedding the tube in the groove so that the outer surface of the tube does not exceed the outer surface of the frame, or in other words, the tube is disposed in the groove so that it does not protrude from the surface of the frame. The present invention allows the lead to smoothly slide in the direction of the racket tip when the centrifugal force is exerted to the racket, and to smoothly slide downward in the direction of the grip by the force of gravity when the racket is stood upwards.

DETAILED DESCRIPTION OF THE INVENTION

Embodiments of the present invention will be explained in detail hereinafter with reference to the figures.

Figure 1:
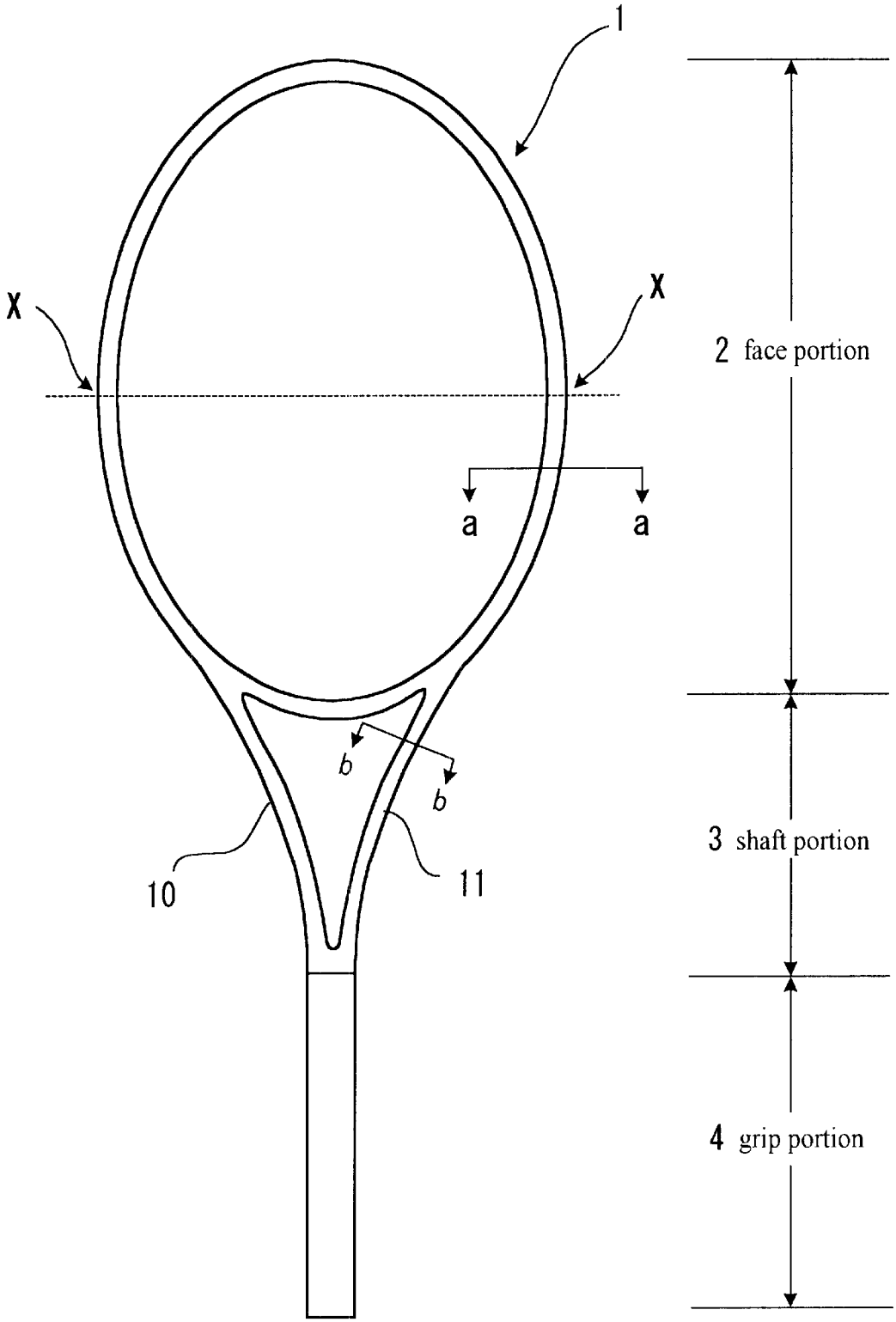
FIG. 1 is a plan view of a racket according to the first aspect of the present invention.
Figure 8:
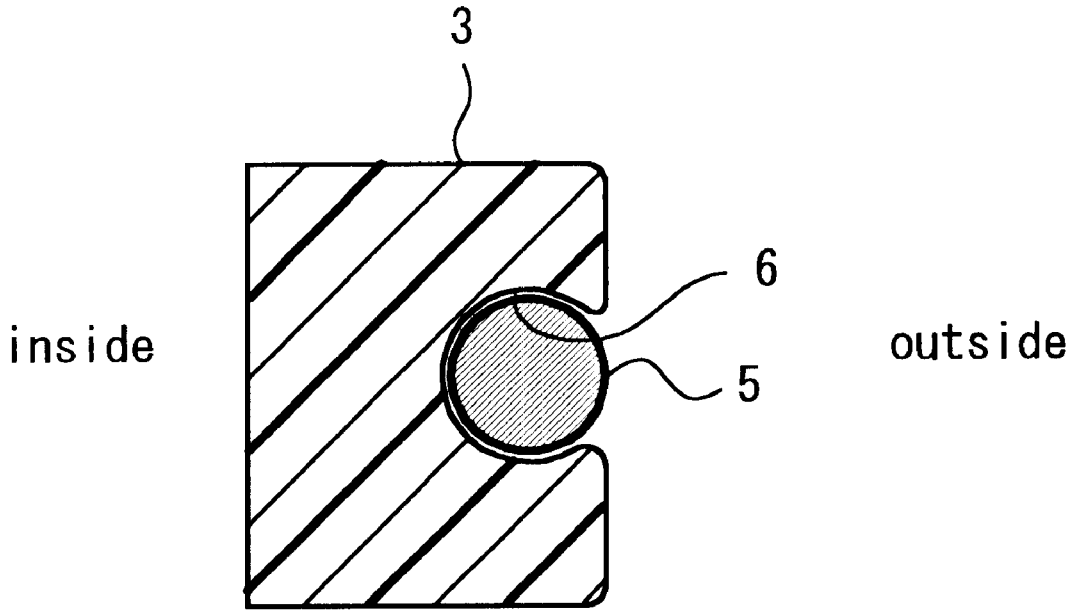
FIG. 8 is a cross-sectional view of a frame taken along line b—b of a racket shown in FIG. 1.

FIG. 1 is a front view of a racket of an embodiment of the present invention. FIGS. 2 through 5 are cross sectional views of a frame comprising a face portion of a racket taken along line a—a in FIG. 1. FIG. 8 is a cross sectional view of a frame comprising a shaft portion taken along line b—b in FIG. 1.

The racket 1 shown in FIG. 1 comprises a face portion 2, a shaft portion 3, and a grip portion 4 which altogether comprises a frame body as shown in FIG. 1.

The face portion 2 generally is formed in a shape of an oval or an egg, and provides a through-hole for penetration with stringing via grommet (not shown in the drawings). The left and right portions of the frame comprising a face portion are preferably substantially linearly formed.

Here, substantially linearly means a radius of curvature R for an inner circumference and an outer circumference of the face portion comprises a curve closer to a straight line than a curvature of circle having 150 mm (approximately 5.9 inches) diameter, or a line substantially straight. Here, line X—X in FIG. 1 demonstrates a maximum distance in width of the frame portion found near the center of the face portion 2.

The grip portion 4 is a portion for holding a racket covered with soft material such as leather or urethane.

The shaft portion 3 defines a portion between the face portion 2 and the grip portion 4, comprised by a left and a right arm 10 and 11 respectively. In the present embodiment, the shaft portion 3 as a whole is formed in a shape of letter "V", which is open upwards.

A frame body comprised by the face portion 2, shaft portion 3, and the grip portion 4 could be made of metal materials such as titanium, titanium alloy, aluminum, and aluminum alloy, with preference to fiber reinforced plastic (FRP).

Supplemental reinforcement fibers which may be added to the fiber reinforced plastic includes for example, carbon fibers, boron fibers, alumina fibers, super thin steel wires, Ti—Si—C—O fibers (product name: "Tilano fiber"), aramid fibers (aromatic polyamide), aromatic polyester fibers, ultra-high-molecular-weight-polyethylene, and glass fibers, with preference to carbon fibers and glass fibers in terms of cost effectiveness.

The synthetic resin comprising the fiber reinforced synthetic resin includes for example, epoxy resin, unsaturated polyester resin, vinyl ester resin, with preference to epoxy resin from the standpoint of strength, durability and cost.

There is no limitation of a method in manufacturing such racket, and any conventional process of laminating a plurality of pre-preg sheets around a core shaft, and placing it in a cavity of a mold with added heat to form a shape of racket frame, could be acquired.

The aforementioned racket preferably furnishes a plurality of grooves having lengths of 10% to 20%, more preferably 13% to 17%, of an entire circumference of the face portion of the frame body. The grooves are provided at the portions of maximum width X of the frame, and thus the racket face. In the groove, tubes having both ends closed are disposed and enclosing weights to freely move around are disposed. The circumferential length of the frame comprising the face portion preferably is 80 to 100 cm (approximately 31.5 to 39.4 inches).

In this case, at two portions of the frame including at the portion of the maximum width X of the frame comprising the face portion, grooves in the lengths of 100 mm to 200 mm (approximately 3.94 to 7.87 inches), preferably in the lengths of 130 mm to 170 mm (approximately 5.12 to 6.69 inches) are provided, and in the groove, preferably a tube closed on both ends and enclosing weights to freely move around within is disposed.

In the present embodiment, the groove for embedding the tube is formed in the shape and the size corresponding the tube for accommodating the tube, hence the length of the tube and the length of the groove are substantially identical.

When the length of the groove (or tube) is too long, the weight of the racket increases, thus prevents the smooth shifting of the center of gravity. On the other hand, when the length of the groove (tube) is defined too short, the center of gravity is restricted from shifting enough, which could degrade the performance of the racket.

The groove forming method is not limited and could acquire various methods for instance, RTM (Resin Transfer Molding) method which utilizes moldable die for forming frames provided with convex portions corresponding to concaves found in the groove, RIM (Reaction Injection Molding) method which forms a groove directly in the core member. These methods allow configuration of the grooves in predetermined lengths and shapes, at same time when forming the grooves themselves.

Figure 2:
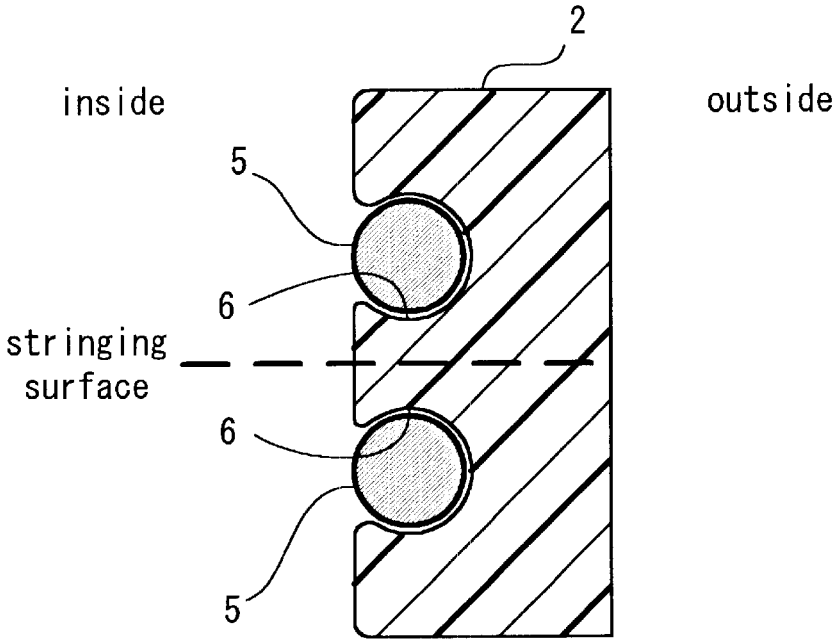
FIG. 2 is a cross-sectional view of a frame comprising a face portion, taken along line a—a in FIG. 1.
Figure 3:
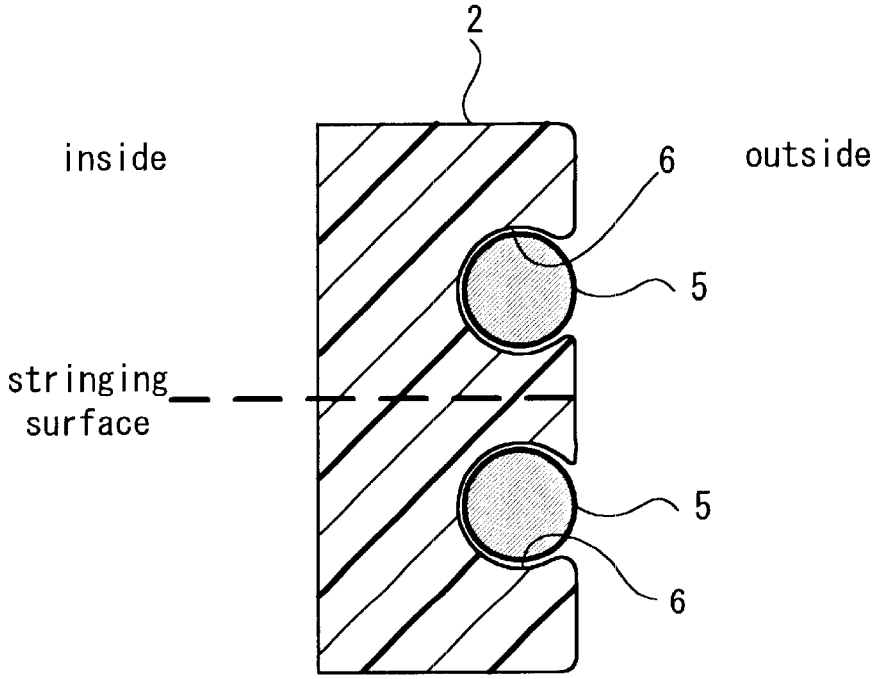
FIG. 3 is a cross-sectional view of a frame comprising a face portion, taken along line a—a in FIG. 1.
Figure 4:
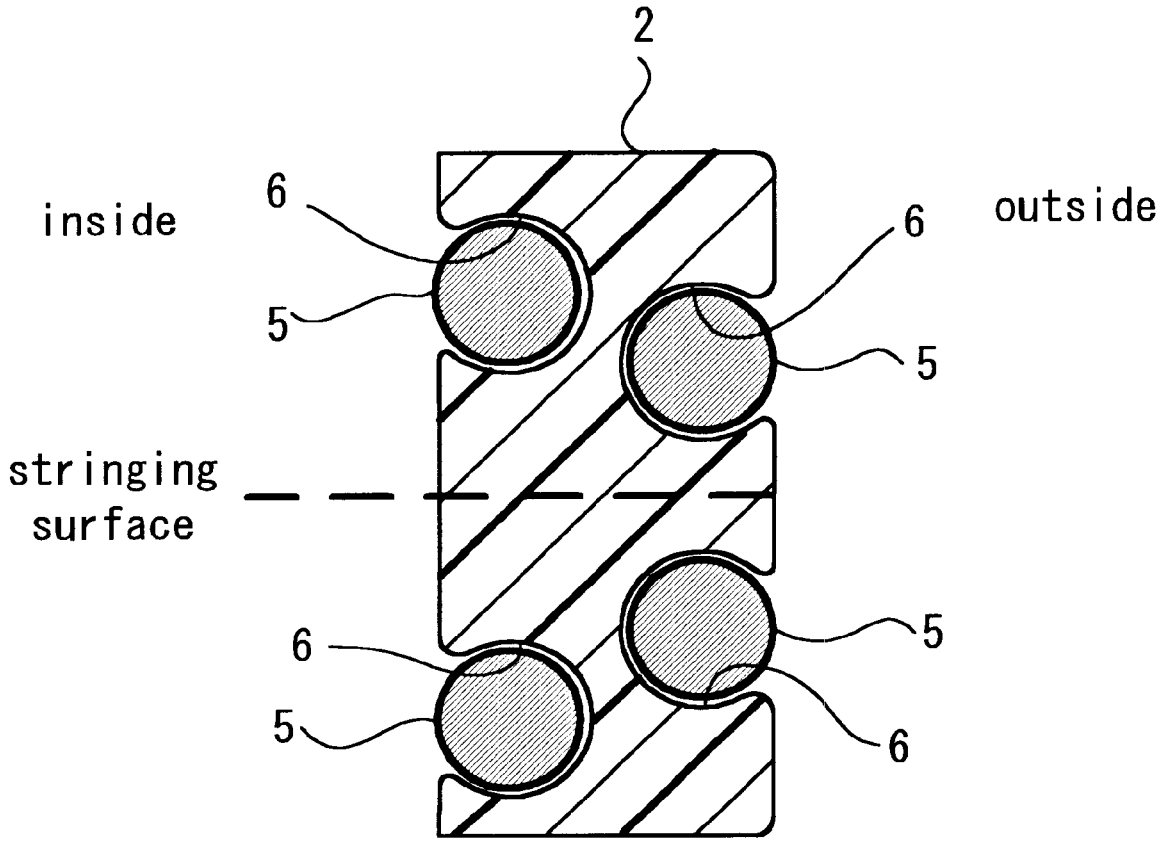
FIG. 4 is another cross-sectional view of a frame taken along line a—a of a racket shown in FIG. 1.
Figure 5:
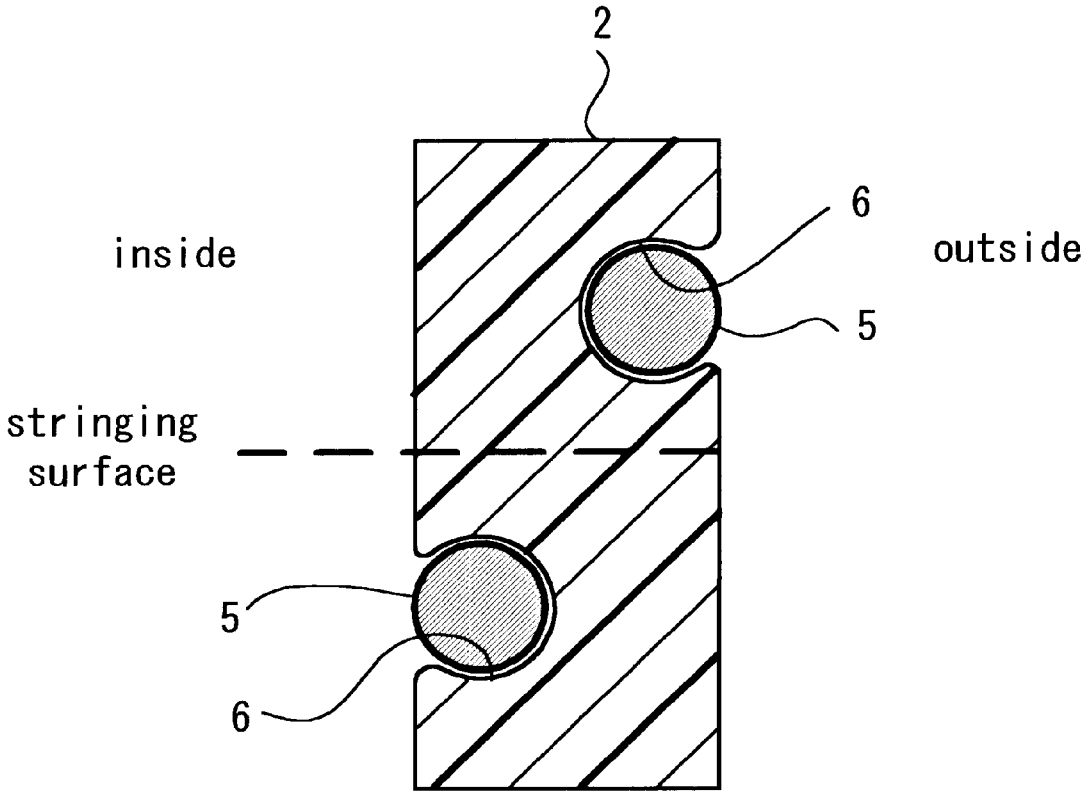
FIG. 5 is still another cross-sectional view of a frame taken along line a—a of a racket shown in FIG. 1

The groove (tube) is preferably provided in plurality in even numbers at two portions including in the portions of the maximum width of the frame. Preferably two or four grooves are provided in order to maintain a weight balance of the racket. For instance, as shown in FIG. 2, it is possible to provide two grooves respectively at two surfaces of the frame (comprising the racket) facing inwards in a portion of maximum width of the frame, to form the total of four grooves located to oppose each pair intervening the stringing portion. The grooves could likewise be formed at two portions at the maximum width of the racket defined on outer surfaces of the frame as shown in FIG. 3. Alternatively, the total of eight grooves could be formed two at the inner surface and two at the outer surface respectively for the left and right frames as shown in FIG. 4. Moreover, the grooves could be formed one at inner surface and one at outer surface of the frame to bring the total number of grooves to four, as shown in FIG. 5.

The maximum width portions X, and the vicinity of X (i.e., locations preferably covering up to X+ or −5 cm (approximately 1.97 inches)) of the frame comprising the racket are substantially parallel with the grip portion 4 as shown in FIG. 1, the tube could be disposed substantially straight (i.e., the groove is formed in the frame in longitudinal direction of the racket parallel to the grip portion 4), thus allowing the weight enclosed in the tube to slide smoothly.

The tube could be formed of rigid materials having light specific gravity, for instance, rubber, plastic, and elastomer.

Of these rigid materials, Polyethylene (PE), Polyamide resin (PI), Thermoplastic Polyurethane (TPU) are available, with preference to PE by its property of light weight, easy processing, transparency and uniqueness of design.

Figure 6:
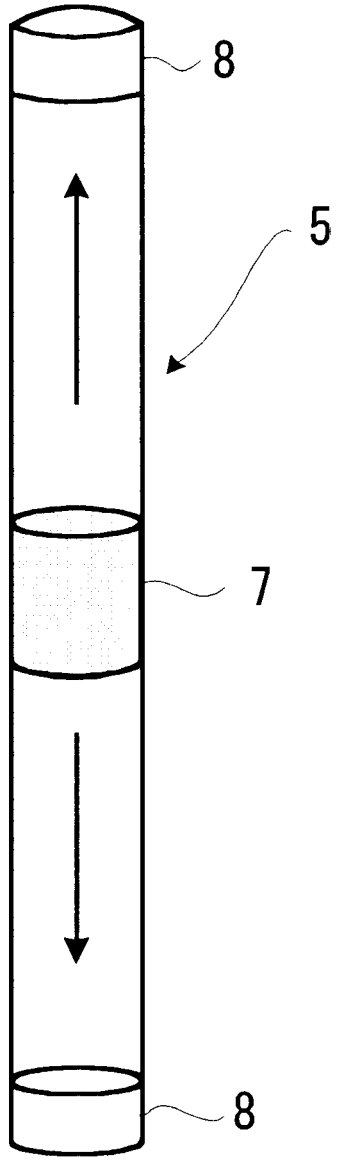
FIG. 6 is an exploded perspective view of a closed tube enclosing a slidable weight.

The tube preferably has an internal diameter of 3 mm or larger, more preferably within the range of 4 to 7 mm (approximately 0.16 to 0.28 inches), while outer diameter preferably is 4 mm or larger, more preferably 5 to 8 mm (approximately 0.20 to 0.31 inches), in order to realize the smooth slide of the weight 7 into the direction of arrow as shown in FIG. 6.

When the diameter of the tube is too large, in addition to the fact that the tube cannot be disposed within the frame, the formation of the frame becomes difficult and will lead to deterioration of the strength of the frame. On the other hand, when the diameter of the tube is too small, there is a risk of sacrificing a sufficient weight shift effect of the weight enclosed in the tube adjusted to the size of the tube. Here, the tube preferably is formed as straight as possible from the viewpoint of allowing easy and smooth sliding of the weight inside the tube.

An upper end portion and a lower end portion of the tube 5 shown with numeral 8—8 as shown in FIG. 6 are closed by elastomers such as rubber, polyurethane, or shock absorbers (i.e., cushioning) such as spring. With such arrangement at both end portions, the shock and sound caused during the sliding of the weight is absorbed.

Figure 7:
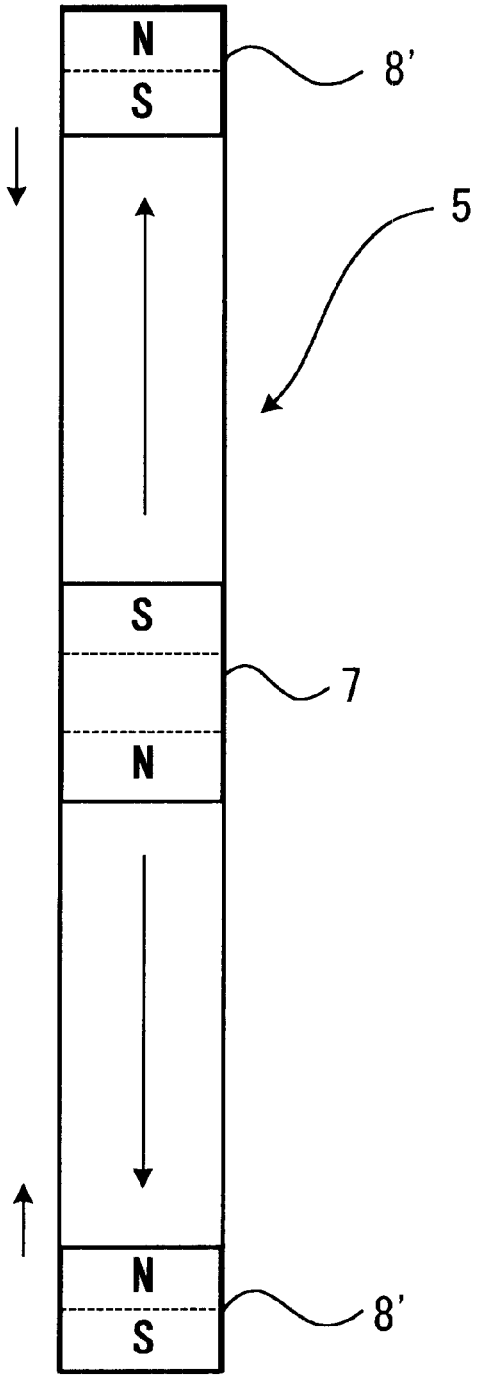
FIG. 7 is an exploded perspective view of a tube closed both ends by magnets enclosing a movable weight.

Alternatively as shown in FIG. 7, magnets 8'—8' could be utilized as shock absorbing material disposed at both end portions of the tube 5. While the weight 7 enclosed in the tube could be provided with magnetic polarity on both end portions of the weight respectively arranged so that they have the same polarity as the polarity of the magnet at the corresponding end portions of the tube. The impulse and the sound of collision are considerably eased by repulsing magnetic forces interacting between the end portion of the weight and the corresponding end portion of the tube. Here, the magnetic forces of the end portions of the weight and the corresponding end portions of the tube are not limited as long as magnetic strength is adjusted to softly touch between the two when the racket is strongly swung.

Also, a small volume of lubricating agent such as oil could preferably be added or low friction treatment could be applied at the inner surface of the tube. The type of low friction treatment is not limited, for instance, silicone coating could be adopted. When the lubricating agent such as oil is added, it could also function as anti-corrosive for the weight when the weight is made of metal materials.

The aforementioned tube could be fixedly adhered to the inner surface of the groove by adhesive and the like. In such cases the tube could be affixed on one side surface of the frame either on inner surface or the outer surface of the frame, or on both surfaces of the frame. At this time, the tube 5 is preferably adhered in the groove in a state of non-protrusion from the surface of the frame to prevent being damaged when an external force is exerted, or hampering the swing by being projected from the surface of the frame.

The number of weights to be enclosed in the tube could be one or more, and the total weight of the weights are preferably 2 to 10 grams (approximately 0.07 to 0.35 ounces), and more preferably 3 to 8 grams (approximately 0.11 to 0.28 ounces) per tube. The total weight of the weights in the racket is preferably 4 to 40 grams (approximately 0.14 to 1.41 ounces), more preferably 12 to 32 grams (approximately 0.42 to 1.13 ounces).

When the weight of the weights are too light, the weight shift effect is inferior. On the other hand, when the weight of the weights are too large, the distance of the weight shift is short. The length of the weight becomes large, and the moment of inertia cannot increase enough to fully realize the merit of present invention.

The form of the weight is not limited. It could be any form desired for instance, cylinder, sphere, or cube, but from the view point of increasing the weight per volume, a solid cylinder is preferred.

For instance, such solid cylinder weight preferably is a high specific gravity material having specific gravity of 7 or greater, more preferably having specific gravity in the range of 7 to 15. Practical example of such material could be stainless steel, copper alloy, lead, lead alloy, tungsten, and tungsten alloy, with preference to tungsten alloy. Further, high specific gravity powders such as tungsten or lead powder could be added to resin, rubber, or elastomer to obtain the preferable weight Moreover, resin or rubber covered on the surface of the aforementioned metal material could also qualify for preferable weight since such configuration helps reduce noises of the weight sliding inside the tube.

The racket preferably is provided with a closed tube enclosing a movable weight at the left and right arms 10 and 11 comprising the shaft portion 3, as shown in line b—b in FIG. 1. In such cases, the tube could be disposed either on the inside surface or the outside surface respectively of the left and right arms comprising the frame, or on both inside and outside surfaces of the left and right arms respectively comprising the frame, but from the viewpoint of retaining long distance for the weight to slide, tubes preferably are disposed on outside surfaces of the left and right arms of the frame comprising the shaft.

Consequently, by providing closed tubes enclosing a movable weight at the frame comprising shaft portion in addition to the tubes provided at the frame comprising the face portion, the effect of the weight shift could be obtained even greater, and at the same time, the moment of inertia will also become great.

When the tubes are disposed at the frame comprising the shaft portion, relative to the frame comprising the face portion, there is no need to bypass the stringing arrangement, the internal diameter of the tube could be defined relatively large, preferably from 5 to 10 mm (approximately 0.20 to 0.39 inches), more preferably from 6 to 8 mm (approximately 0.24 to 0.31 inches), while outer diameter of the tube could be formed in the size of 6 to 11 mm (approximately 0.24 to 0.43 inches), specifically from 7 to 9 mm (approximately 0.28 to 0.35 inches).

The moment of inertia obtainable by the racket of the present invention which provides closed tubes enclosing movable weight at the frame comprising the face portion and or at the frame comprising the shaft portion preferably is greater than a racket without a tube by $2.0\times10^{-3}$ kg·m$^2$ (6.8 lb·in$^2$)or greater, more preferably $2.0\times10^{-3}$ to $6.0\times10^{-3}$ kg·m$^2$ (approximately 6.8 to 20.5 lb·in$^2$).

The maximum moment of inertia of the racket during the swing preferably is $37.0\times10^{-3}$ to $45.0\times10^{-3}$ kg·m$^2$ (approximately 126.5 to 153.9 lb·in$^2$), and more preferably is $40.0\times10^{-3}$ to $43.0\times10^{-3}$ kg·m$^2$ (approximately 136.8 to 147.1 lb·in$^2$). Here, the maximum moment of inertia is referred to as a moment of inertia when the weight is slid to the tip of the racket during the swing.

Figure 9:
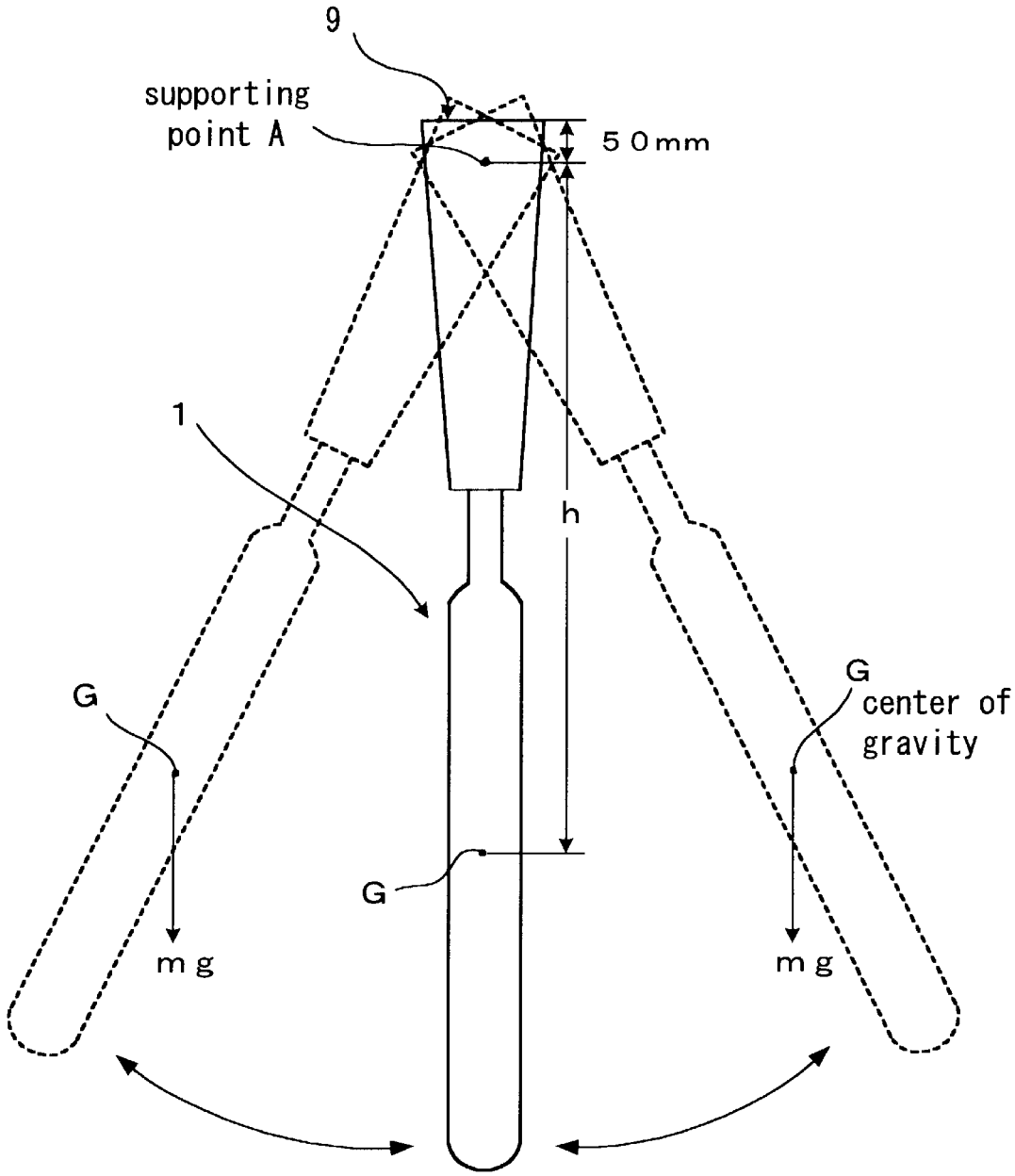
FIG. 9 is a view for explanation to calculate moment of inertia.

Here, the moment of inertia of the racket is calculated as shown in FIG. 9, by defining a supporting point A at 50 mm (approximately 1.97 inches)from the end of the grip 9, swinging the racket in a pendulum by supporting point A fixed, and by applying resultant cycle into the formula below. The point G in FIG. 9 demonstrates the center of gravity of the racket.

$$\text{Moment of inertia } I(kg\cdot m^2)=(T/2\pi)^2 mgh \qquad \text{Formula 1}$$

Here, T represents a cycle (sec) when the racket is being swung, g represents gravimeter (i.e., 9.8 m/sec$^2$), h represents a distance (m) between the point A and the center of gravity G, while m represents a racket weight (kg).

The racket of the present invention could be used as a racket for use in tennis, badminton, squash and various other sports, with preference to tennis.

The racket of the present invention is adjustable in size to correspond to the Tennis rules, i.e., the total length of the racket up to 81.28 cm (approximately 32 inches), total width of the racket up to 31.75 cm (approximately 12.5 inches). Moreover, the racket could be more useful and easy for maneuvering when the racket furnished with stringing preferably weighs 340 g (approximately 12.0 ounces) or less, more preferably 210 to 300 g (approximately 7.41 to 10.58 ounces).

The present invention is not limited to the specifically disclosed embodiments, and variations and modifications may be made without departing from the present invention.

Embodiments of the present invention will be described hereinafter along with explanation of comparative examples, however, the present invention is not limited to these embodiments.

Embodiment 1

The tennis racket frame is provided by RTM method using a Carbon Fiber Reinforced Plastic (CFRP). At two portions covering the point of maximum width of the face portion comprising the racket frame, respectively two groves (total of four grooves) in the length of 160 mm (approximately 6.30 inches)are formed in opposing relationship to each other at inside surface of the frame intervening the stringing as shown in FIG. 2. Within the grooves, tubes enclosing slidable weights are fixed with adhesive. The entire circumference of the frame comprising the face portion was 94 cm (approximately 3.70 inches).

For the tube, material made of transparent polyester in the length of 160 mm (approximately 6.30 inches) (equal to 17% of the entire circumference of the frame comprising the face portion) having 5 mm (approximately 0.20 inches)outer diameter and 4 mm (approximately 0.16 inches) internal diameter was used. The both ends of the tube was closed with shock absorbing material (polyurethane thermoplastic elastomer).

For the weight, a weight made of tungsten alloy in the form of solid cylinder having specific gravity of approximately 10 with internal diameter of 3.8 mm (approximately 0.15 inches), outer diameter of 30 mm (approximately 1. 18 inches)weighing 3.5 g (approximately 0.12 ounces)was used.

Embodiment 2

The tennis racket of this embodiment was provided by adding a groove (total of two grooves) respectively at outer surfaces of the left and right arms of the frame connecting the face portion and the grip portion of the first embodiment, as shown in FIG. 8. The tubes in the lengths of 120 mm (approximately 4.72 inches), having internal diameter of 5 mm (approximately 0.20 inches), outer diameter of 4 mm (approximately 0.16 inches)enclosing weights are fixedly adhered to the grooves.

Embodiment 3

As shown in FIG. 7, the racket in this embodiment is a racket of the first embodiment except that magnets are used to close both ends of the tube (lid), while weight is being magnetized on both ends with polarity identical to the polarity of the corresponding magnet closing the tube are provided.

The racket of this embodiment demonstrates a same level of moment of inertia as the first embodiment, while noise of sliding and colliding of the weight against the surface of the tube end (lid) was reduced by the resisting magnetic force exerted between the weight and the lid.

Embodiment 4

As shown in FIG. 7, the racket in this embodiment is a racket of the second embodiment except that magnets are used to close both ends of the tube (lid), while weight is being magnetized on both ends with polarity identical to the polarity of the corresponding magnet closing the tube or lid are provided.

The racket of this embodiment demonstrates a same level of moment of inertia as the second embodiment, while noise of sliding and colliding of the weight against the surface of the tube end (lid) was reduced by the resisting magnetic force exerted between the weight and the lid.

COMPARATIVE EXAMPLE 1

Using the racket of the first embodiment, the groove in the length of 90 mm (approximately 3.54 inches)was provided at the frame comprising a face portion, within the groove, a tube in the length of 88 mm (approximately 3.46 inches) (equal to 9.0% of the entire circumference of the frame) made of polyethylene was embedded as shown in FIG. 2. The tube was fixedly adhered to the groove by an adhesive.

COMPARATIVE EXAMPLE 2

A conventional tennis racket commercially available which does not provide a tube enclosing a weight is provided.

The tennis rackets of embodiment 1, 2 and comparative examples 1, 2 were evaluated by the method described below to evaluate moment of inertia, maneuverability, and the rebounding force of a ball. The results are shown in Table 1.

<Moment of Inertia>

As shown in FIG. 9, each racket was swung in a pendulum with supporting point A defined at 50 mm (approximately 1.97 inches)from the end of the grip 9 of the racket fixed. The resultant cycle was applied to the formula below to earn moment of inertia.

$$\text{Moment of inertia } I(kg\cdot m^2)=(T/2\pi)^2 mgh \qquad \text{<Formula 1>}$$

Here, T represents a cycle (sec) when the racket is being swung, g represents gravimeter (i.e., 9.8 m/sec$^2$), h represents a distance (m) between the supporting point A and the center of gravity G, while m represents a racket weight (kg).

<Racket Maneuverability and Rebounding Force of a Ball>

Evaluation for maneuverability of the racket and rebounding force of the ball were conducted for each racket by twenty players actually played with the rackets using tennis balls.

O: satisfactory level in both racket maneuverability and rebounding force

Δ: normal level in both racket maneuverability and rebounding force

X: inferior level in both racket maneuverability and rebounding force

TABLE 1

| | Embodiment 1 | Embodiment 2 | Comp. Ex. 1 | Comp. Ex. 2 |
|---|---|---|---|---|
| Moment of Inertia ($kg \cdot m^2$) | | | | |
| during the swing (minimum) | $37.3 \times 10^{-3}$ | $36.9 \times 10^{-3}$ | $37.9 \times 10^{-3}$ | $37.8 \times 10^{-3}$ |
| during the swing (maximum) | $40.1 \times 10^{-3}$ | $42.2 \times 10^{-3}$ | $39.3 \times 10^{-3}$ | |
| racket maneuver-ability | ○ | ○ | ○ | Δ |
| ball rebound | ○ | ○ | Δ | X |

"During the swing (minimum)" refers to a minimum moment of inertia accomplished during the swing in a state when the weight is slid at the side of the grip. On the other hand, "During the swing (maximum)" refers to a maximum moment of inertia accomplished during the swing when the weight is slid in the direction of the tip of racket.

As is clear from the Table 1, the racket of embodiment 1 and 2 of the present invention are superior compared to conventional rackets (comparative example 2) for increase in maximum moment of inertia by approximately $2.0\times10^{-3}$ to $6.0\times10^{-3}$ $kg\cdot m^2$ (approximately 6.8 to 20.5 $lb\cdot in^2$), and also for their maneuverability and the force of rebound of the ball. Also, since the racket of comparative example 1 has shorter length of the tube, the weight enclosed in the tube does not have enough length to slide to exert increased moment of inertia.

As described, according to the present invention, a racket preferably a tennis racket capable of shifting its center of gravity during the swing, and by increased moment of inertia, allows hitting strong balls is earned.

What is claimed is:

1. A racket, comprising a frame body having a face portion having two maximum width points, a shaft portion, and a grip portion, wherein at least one first groove, which is a length of 10% to 20% of the entire circumference of the face portion, is provided at a first of the two maximum width points of the face portion, at least one second groove, which is a length of 10% to 20% of the entire circumference of the face portion, is provided at a second of the two maximum width points of the face portion, and closed tubes, each enclosing a slidable weight weighing 2 g to 10 g (0.07 to 0.35 ounce), are fixedly embedded in the grooves.

2. The racket of claim 1, wherein the length of the grooves is 100 mm to 200 mm (3.94 to 7.87 inches).

3. The racket of claim 1, wherein the at least one first groove is an even number of first grooves and a stringing surface is provided between the even number of first grooves, and wherein the at least one second groove is an even number of second grooves and a stringing surface is provided between the even number of second grooves.

4. The racket of claim 3, wherein the even number of first grooves and the even number of second grooves are one of two and four.

5. The racket of claim 1, wherein the grooves for fixedly embedding the tube are provided at at least one of an inner surface of the frame body or an outer surface of the frame body.

6. The racket of claim 1, wherein a surface of at least one of the tubes does not protrude beyond a surface of the frame body.

7. The racket of claim 1, wherein the shaft portion includes a left arm and a right arm, and wherein additional grooves embedding tubes enclosing slidable weights are formed respectively at left and right arms of the frame body.

8. The racket of claim 7, wherein the additional grooves embedding tubes enclosing slidable weights are formed respectively at outer surfaces of the left and the right arms of the frame.

9. The racket of claim 7, wherein at least one of the tubes is closed on both ends with magnets and the weight enclosed is magnetized on both ends so that the polarity at each end of the weight is identical to the polarity of the corresponding magnet on either end of the tube.

10. The racket of claim 7, wherein a maximum moment of inertia of the racket during the swing is at least $2.0\times10^{-3}$ $kg\cdot m^2$ (6.8 $lb\cdot in^2$) greater than a maximum moment of inertia of a racket without having closed tube enclosing slidable weight.

11. The racket of claim 1, wherein a substantially straight portion parallel to the grip portion is provided in the vicinity of the maximum width points of the face portion.

12. The racket of claim 1, wherein the tubes are substantially straight and an internal diameter of the tubes is greater than 3 mm (0.12 inch).

13. The racket of claim 1, wherein at least one of the tubes includes two ends, and both ends of the tube are closed with shock absorbing materials.

14. The racket of claim 1, wherein at least one of the tubes is closed on both ends with magnets and the weight enclosed is magnetized on both ends so that the polarity at each end of the weight is identical to the polarity of the corresponding magnet on either end of the tube.

15. The racket of claim 1, wherein a lubricating agent is added in at least one of the tubes or a low friction treatment is applied at internal surface of at least one of the tubes.

16. The racket of claim 1, wherein the weight is a tungsten alloy in a form of solid cylinder.

17. The racket of claim 1, wherein a total weight of the slidable weights is 4 to 40 g (0.14 to 1.41 ounces) for the racket.

18. The racket of claim 1, wherein a maximum moment of inertia of the racket during the swing is $37.0\times10^{-3}$ to $45.0\times10^{-3}$ $kg\cdot m^2$ (126.5 to 153.9 $lb\cdot in^2$).

19. The racket of claim 1, wherein a maximum moment of inertia of the racket during the swing is at least $2.0\times10^{-3}$ $kg\cdot m^2$ (6.8 $lb\cdot in^2$) greater than a maximum moment of inertia of a racket without having closed tube enclosing slidable weight.

20. The racket of claim 1, wherein the racket is one of a tennis racket, a badminton racket, and a squash racket.

* * * * *